US005364016A

United States Patent [19]

Capy et al.

[11] Patent Number: 5,364,016

[45] Date of Patent: Nov. 15, 1994

[54] PLEATED WRAPPER FOR SOLID LOOSE ARTICLES

[75] Inventors: Gilbert Capy; Akiva Buchberg, both of Jarnioux, France

[73] Assignee: Wrapco International B.V., Rotterdam, Netherlands

[21] Appl. No.: 946,766

[22] Filed: Sep. 17, 1992

[30] Foreign Application Priority Data

Sep. 24, 1991 [FR] France ..... 91-11965

[51] Int. Cl.[5] ..... B65D 65/04

[52] U.S. Cl. ..... 229/87.03; 229/107

[58] Field of Search ..... 229/87.03, 107, DIG. 13

[56] References Cited

U.S. PATENT DOCUMENTS

| | | | |
|---|---|---|---|
| 1,846,949 | 2/1932 | Clark | 229/87.03 |
| 1,948,615 | 2/1934 | Clark | 229/87.03 |
| 2,145,481 | 1/1939 | Harvey | 229/DIG. 13 |
| 3,026,656 | 3/1962 | Rumsey, Jr. | 383/103 |
| 5,125,564 | 6/1992 | Capy | 229/87.03 |
| 5,131,586 | 7/1992 | Capy | 229/87.03 |

*Primary Examiner*—Stephen P. Garbe

*Attorney, Agent, or Firm*—Kane, Dalsimer, Sullivan, Kurucz, Levy, Eisele and Richard

[57] ABSTRACT

A wrapper is formed of a semi-rigid section is fixed to a pleated section made of a thin flexible sheet. The semi-rigid unpleated section is folded to form a cavity for containing loose products. The pleated section is deployed around the cavity to form a self-closing wrapper. After opening the wrapper the products may be consumed from either section. The wrapper is particularly suited for french fries or pizza pies.

6 Claims, 4 Drawing Sheets

PLEATED WRAPPER FOR SOLID LOOSE ARTICLES

BACKGROUND OF THE INVENTION a. Field of the Invention

This invention pertains to a packaging of products and more particularly to a packaging formed of a thin pleated sheet and a semi-rigid sheet adapted for holding loose articles. This invention is an improvement over the pleated wrappers disclosed in U.S. Pat. Nos. 4,795,648; 5,125,564 and 5,131,586.

b. Description of the Prior Art

U.S. Pat. No. 5,131,586 describes a wrapper composed of a thin and flexible pleated sheet and a non-pleated sheet. The non-pleated sheet could be made of the same material as the pleated sheet or a different material having different flexibility and rigidity. The non-pleated sheet is placed about a convex object to be wrapped and then the pleated sheet is deployed to cover substantially or partially both the convex object and the non-pleated sheet. The pleated wrapper can be partially opened to uncover the convex object as required. This wrapper is useful for packaging a single convex object or several objects having matching contours so that they can be grouped or stacked in a relatively compact ensemble. However, this type of packaging is not well suited for packaging loose objects, particularly food stuff such as french fries, fish sticks and so on since these objects cannot be stacked into a mass sufficiently compact to permit the pleated sheet to be employed efficiently around them. It is also impractical to fold the wrapping into a container prior to packaging like a paper bag since the wrapper is formed and deployed around the object simultaneously.

Fast food restaurants and other similar retail food distributors sell french fries and other loose food stuff in bags or cone-shaped containers which are unstable so that they cannot be placed easily on a table, and moreover do not protect their contents from dirt or heat. This traditional type of packaging moreover is very impractical for selling food to customers in cars, i.e. through drive-through windows.

OBJECTIVES AND SUMMARY OF THE INVENTION

In view of the above-mentioned disadvantages of the prior art, it is an objective of the present invention to provide a wrapper formed of thin pleated sheet which may be advantageously utilized for packing several loose objects, such as french fries.

A further objective is to provide a wrapper which is easy to make and is relatively inexpensive.

Yet a further objective is to provide a wrapper to replace traditional french fry containers utilized in fast food restaurants.

The subject invention may also be used to wrap other food stuff such as pizza pies or slices. A wrapper constructed in a accordance with this invention consists of a pleated section formed of a thin flexible sheet and an unpleated section formed of a semi-rigid material. The unpleated section is foldable into a container for holding food stuff while the pleated section may be deployed around the container to form a self-closing wrapper. Preferably, the unpleated section is formed of a central zone and two lateral zones attached to the central zone and foldable into said container.

DETAILED DESCRIPTION OF THE INVENTION

Figure 1:
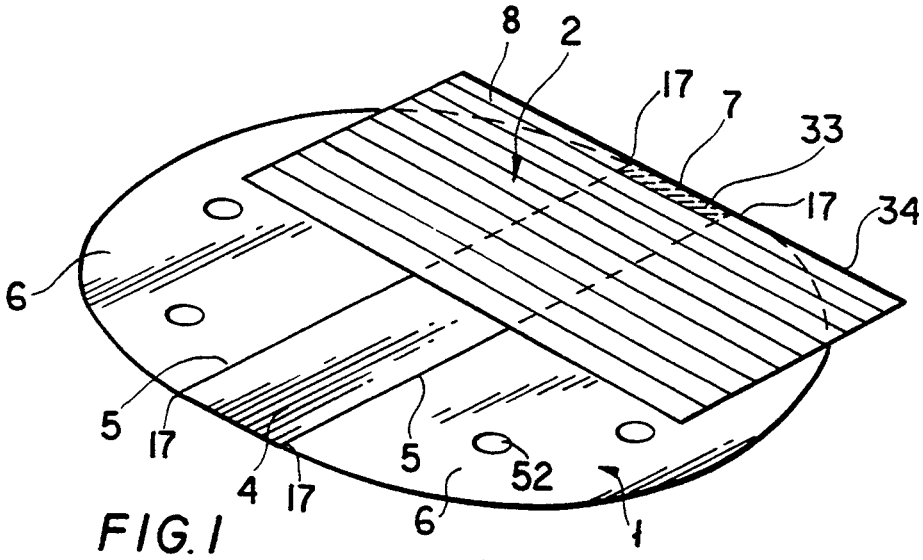
FIG. 1 shows a wrapper constructed in accordance with this invention.
Figure 2:
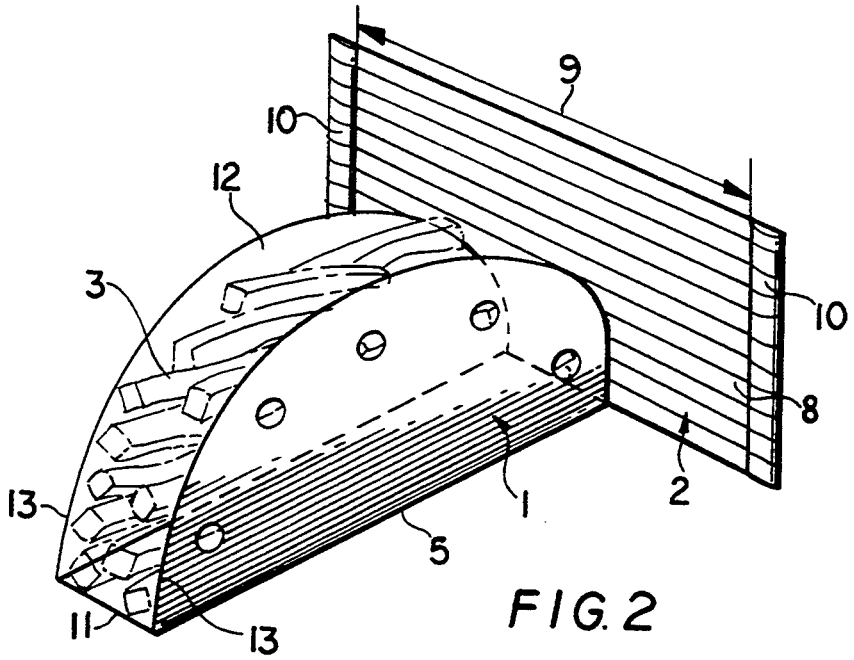
FIG. 2 shows the wrapper of FIG. 1 with the unpleated semi-rigid sheet or zone folded upwardly for holding a plurality of loose solid products.
Figure 3:
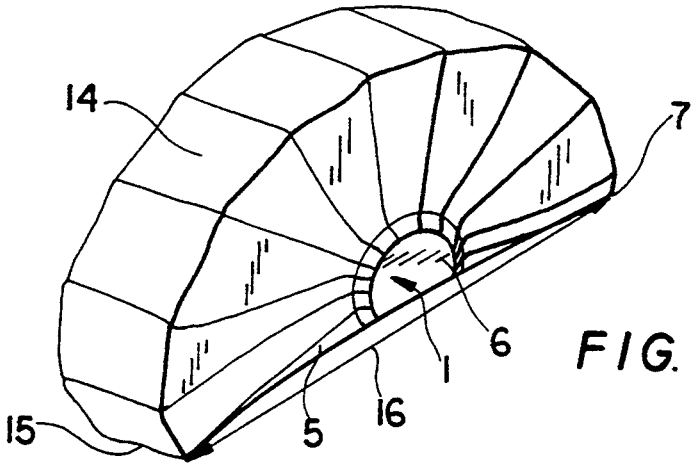
FIG. 3 shows the wrapper of FIG. 2 with the pleated zone deployed for closing the wrapper.

As shown in FIGS. 1–3, a wrapper constructed in accordance with this invention includes a section or zone of paper 1 which is not pleated and which is attached to a pleated sheet 2 constructed from a thin, flexible film of paper as described in the above-mentioned patents. Unpleated section 1 is made of a sheet of paper or cardboard, which is semi-rigid so that it is easy to bend and fold to a desired shape to form a container for loose products such as french fries 3. The filled container thus formed constitutes a convex object to be covered either completely or partially by the pleated sheet 2, as indicated in FIG. 3.

Section 1 is made of a semi-rigid sheet which can be configured into a convex container for holding the loose products without being closed. The container is closed and sealed by the deployment of the pleated section. In FIGS. 1–3 a specific example of the invention is described, it being understood that there are many other possibilities for practicing the same.

In FIGS. 1—3, the wrapper is constructed from an unpleated section 2 formed for example of a cardboard sheet having a central zone having generally an elongated rectangular shape defined between two parallel sides 5, and two semicircular zones 6 having sides 5 as their diameter. Zones 6 extend along an arc 1 of circle of about 180°. Each of the two sides 5 common between rectangular zone 5 and semi-circular zones 6 is formed by a score line in the cardboard sheet which permits pivoting of the zones.

The pleated section 2 has a side or border 34 parallel to the pleats. A portion of this side 34 is provided with a fixation zone 33 for fixing or securing the pleated section to the unpleated section, using any one of the methods of fixation described in U.S. Pat. No. 5,131,586 or other known methods in the art. This fixation zone 33 is disposed substantially in the middle of side 34 of section 2 and extend substantially along the length of side 7 defining the width of rectangular zone 4 in such a manner that the pleats of section 2 are in parallel with side 7. The form, shape the number, of the pleats 8 as well as the length 9 between the pleated fixation zones 10 is calculated using the formulas described in the above-mentioned patents by using as the object to be wrapped a cylindrical object having a diameter equal to sides 5 and a height equal to the width 11 of side 7 perpendicular sides 5.

In order to use the wrapper of FIG. 1, it is sufficient to fold the two semi-circular zones 6 upwardly as shown in FIG. 2 to form with rectangular zone 4 a U-shaped container or receptacle 12. Products 3 are deposited into the receptacle 12 and the pleated section 2 is then deployed around the receptacle to close the opening formed between the arcuate edges 13 of zones 6. The number of pleats 8 required to cover only the semi-circular receptacle 12 may be determined empirically, however in order to obtain a self-closing wrapper about the receptacle 12, the deployed pleated section indicated by numeral 14 shown in FIG. 3 must have a peripheral length which exceeds the length of edges 13. As a result the distance 16 between the extremities 17 of the deployed pleated wrapper 14. The extremities of the pleated wrapper are defined by the points where the fixation zones 33 intersect or meet the sides 5. The two semi-circular zones 6 can be replaced by zones defined by other arcs of circle passing through the extremities 17. Theoretically, the number of such circles is infinite. However, for arcs of circle less than 180° the zones 6 are smaller than the zones described above and the pleated section 2 is not self closing. For arcs exceeding 180° the zones 6 are bigger and the pleated section 2 is self closing.

In the above example, the section 2 is self-closing (i.e. it will remain closed after deployment without any additional means of securing the pleated section to itself or the receptacle 12) because as the section is deployed, it passes through a point diametrically opposite to the zone of fixation 33 and then starts moving back, past side 11 of receptacle 12. As a result, as mentioned above, the distance 16 is smaller than the length of sides 5. For zones 6 having edges 13 subtending an arc less than 180° the section 2 is not automatically self-closing. However, in this situation, the section 2 can be made self-closing by modifying the shape of the pleats. For example, length 9 of the pleats may be reduced. It is the intent of the present invention to cover all the different configurations, whether the lateral zones are defined by arcs of circle, elliptical arcs, or polygonal sides. The receptacle may be formed in other shapes which fit into a convex volume as defined in U.S. Pat. No. 5,125,564.

Methods of securing the two sections together are described in U.S. Pat. No. 5,131,506. The fixation zone 33 is disposed along the length of the pleated section for providing a practical means of deploying the pleated section. However, the fixation zones may be disposed at other locations depending on the intended use of the wrapper.

The holes in the unpleated section are formed to allow the contents of the receptacle 12 to cool off faster after the pleated section is removed or at least opened.

Figure 4:
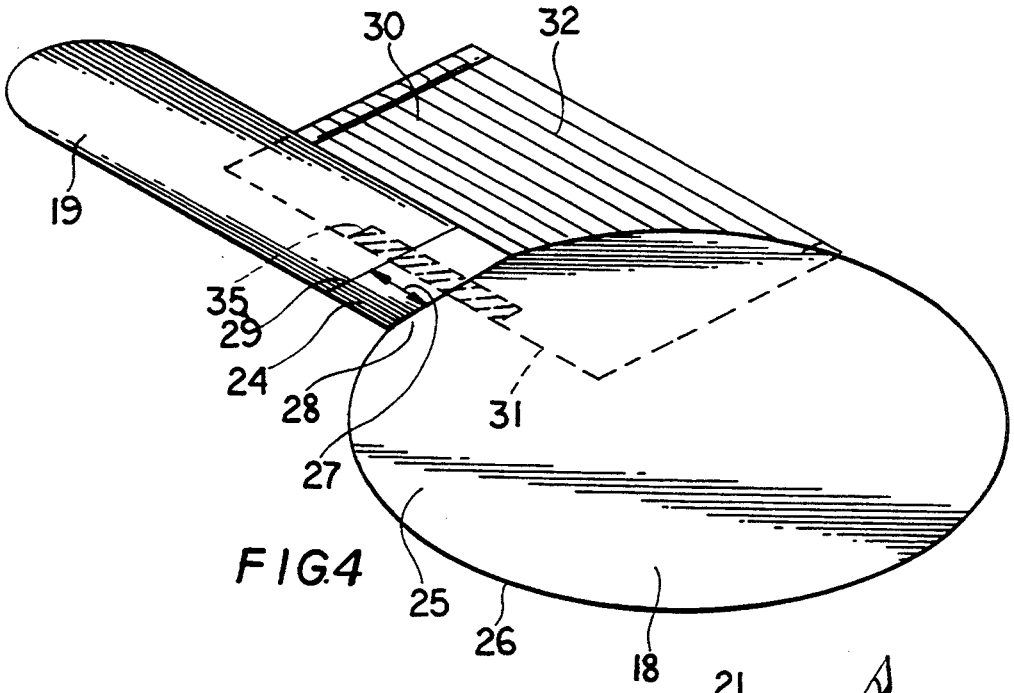
FIG. 4 shows an alternate embodiment of the invention consisting of a wrapper suited for a relatively flat object in the open configuration.
Figure 5:
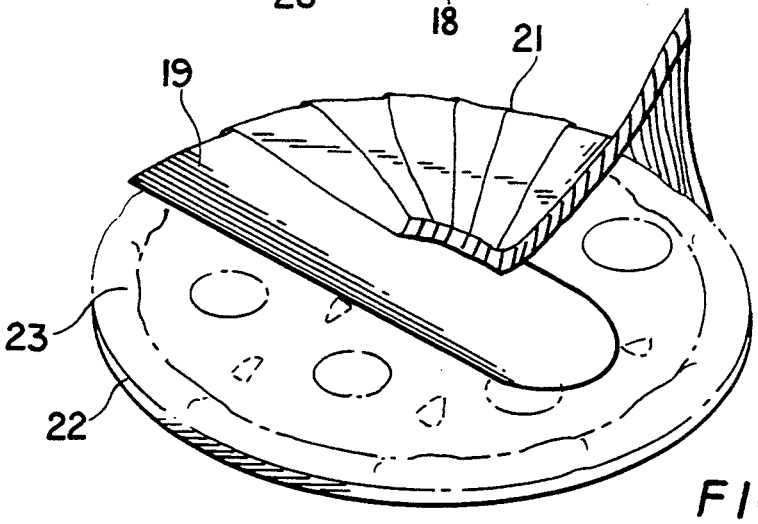
FIG. 5 shows the embodiment of FIG. 4 with the pleated zone being deployed about the flat product.
Figure 6:
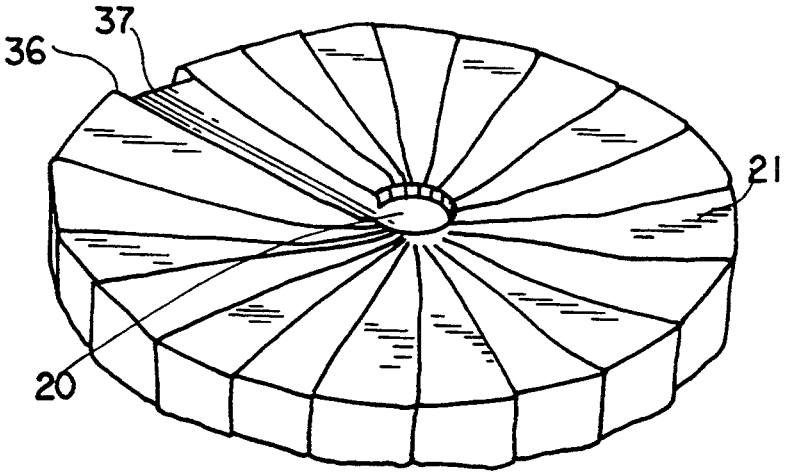
FIG. 6 shows the embodiment of FIGS. 4 and 5 in the closed configuration.

In another embodiment of the invention shown in FIGS. 4–6, a wrapper for a pizza pie is shown composed again of a semi-rigid non-pleated section 25 and a pleated section 32. The non-pleated section is formed of a lateral zone 18 defined by an arc of circle 26 having an angular length exceeding 180° and having a diameter substantially equal to the nominal diameter of a pizza pie 23. This zone 18 forms the support base 22 for the pie as shown in FIG. 5. Section 25 also includes a rectangular zone 24 having a width 27 slightly exceeding the nominal height of the pie 23. The common side 28 between the rectangular zone 24 and zone 18 is sufficiently small so that it does not significantly affect the handling of the wrapper.

Rectangular zone 24 has another size 29 in common with another lateral zone 19. This zone can have a variety of shapes since its main role is to form a protective cover for the central opening left when the pleated section 32 is deployed, as seen in FIG. 6.

Pleated section 30 has a side or border 31 which is parallel with pleats 32 and which is provided with a fixation zone 35. Zone 35 is perpendicular to side 28 of rectangular zone 24. Zone 24 passes substantially through the center of zone 35. The dimensions of the pleated section 30 are determined by using the formulas defined in the above-mentioned patents for a cylindrical object with the diameter of zone 18 and the eight equal to the width 27. The wrapper is used as follows: The wrapper in its open form is positioned as shown in FIG. 4 and a pizza pie is positioned on lateral zone 18. The zones 24 and 19 are folded along sides 28 and 29 to fold over the pizza as shown in FIG. 5 thereby forming again a U-shaped container therefore. If necessary, a sheet of plastic may be inserted between the pizza and the zones 24 and 19 to avoid contact therebetween. Next, the section 30 is deployed around the container and the pizza pie to form a self-closing wrapper as shown in FIGS. 5 and 6, with the outer end of the pleated section covering the inner end, as well as the rectangular zone.

In another embodiment of the invention, a wrapper is generated with the unpleated section having lateral zones 37 which form a wall 38 (FIG. 9) arranged to reduce the opening 39 used to insert pieces of product 40. The opening 39 further permits accumulating the pieces within the container without the necessity of partially deploying the pleated section 41. For example, if the wrapper is to be used for french fries a cone shaped container may be constructed by wherein the wall 38 from a generally rectangular face. This face is formed from two panels 48 of lateral zones 37. Each panel 48 is defined by a score line 42. When the panels 48 are folded over as in FIG. 9, the bottom sides 43 if the panels are disposed adjacent to side 44 of rectangular zone 45. Side 44 is perpendicular to two score lines 46 defining the two longitudinal sides of region 45 and are common with lateral zones 37.

Figure 8:
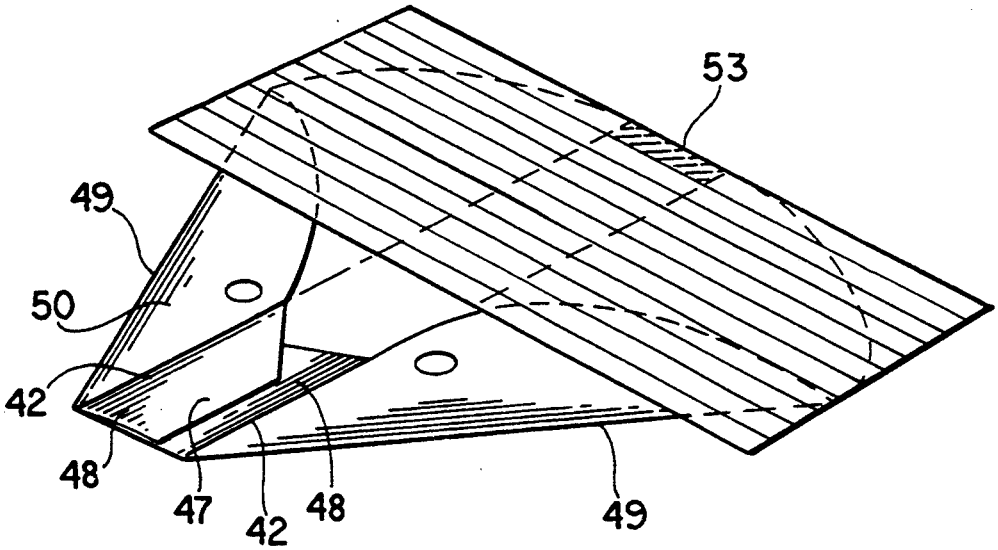
FIG. 8 shows the wrapper of FIG. 7 being folded for storage.
Figure 9:
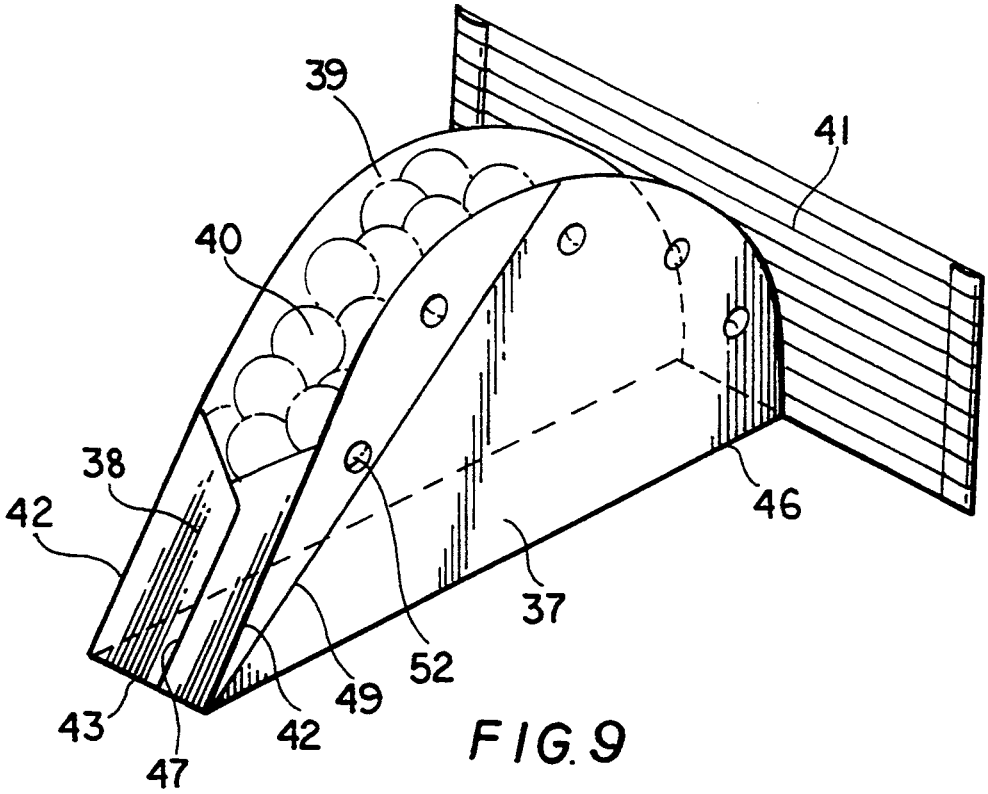
FIG. 9 shows the wrapper of FIGS. 7 and 8 with the cone-shaped container arranged to accept loose products.

A cone-shaped receptacle may be realized in a number of ways, in such a manner that prior to usage, the semi-rigid section may be stored in a flat configuration as shown in FIG. 8. For example, the two panels 48 are affixed to each other by gluing the overlapping zones 47 as shown in FIG. 9.

Figure 7:
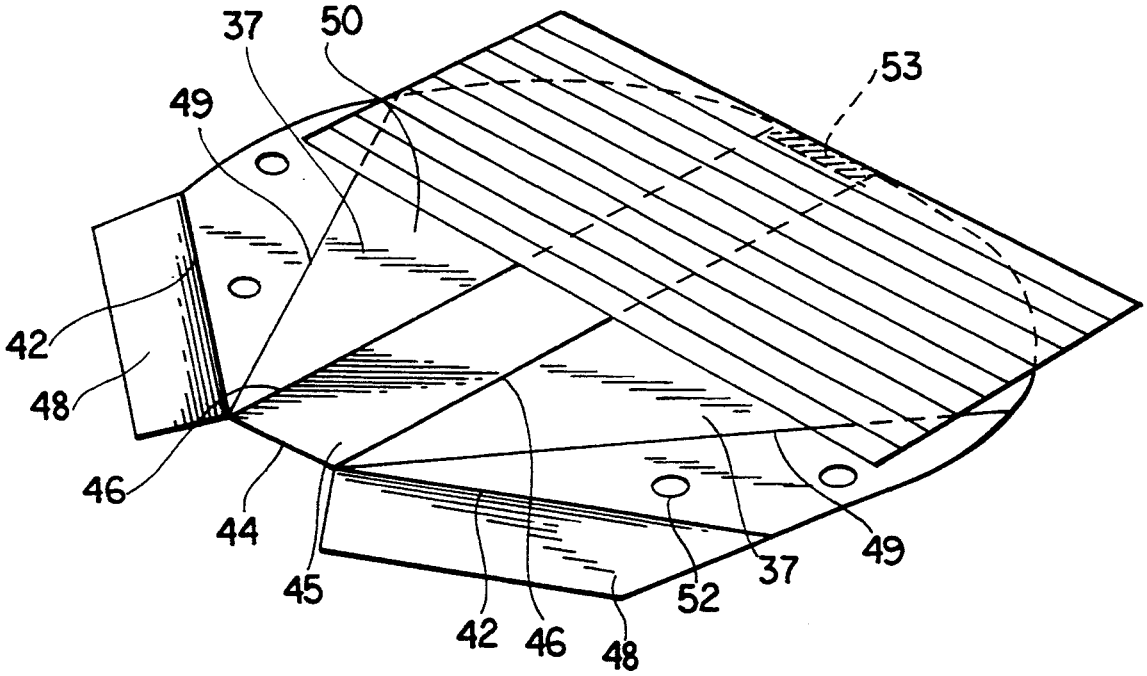
FIG. 7 shows a further embodiment of the invention consisting of a wrapper including a semi-rigid zone cut and shaped to form a cone-shaped container.

The non-pleated semi-rigid section is affixed to the pleated section 41 along a fixation zone 53 disposed at an edge of rectangular zone 45 as shown in FIG. 7. The pleated section is formed in the same manner as described above. After the two sections are secured together in this manner, the section 50 is folded over along lines 49 and the panels 47 are secured to each other along fixation region 48 to form a relatively compact flat undeveloped wrapper shown in FIG. 8.

Before usage, the two lateral zones 37 are folded upwards with respect to central zone 45 along lines 46. This action causes the face 38 to move forward thereby opening automatically into a generally cone shaped container. After the container is filled with lose products 40, the pleated section 41 is deployed around the cone-shaped receptacle to form a self-closing wrapper as shown in FIG. 10.

The wrapper can be provided with aerating means for aerating the loose products 40 for example by providing openings 52 in lateral zones 37. Theses openings are placed so that they are covered by the pleated section to avoid contact between the products 40 and the outside. These openings may be necessary in order to avoid a high level of humidity within the wrapper which may be detrimental to fried food, such as french fries.

The pleated section may be attached and deployed around the cone shaped receptacle in a number of different ways. The dimensions of the pleated section will vary from one configuration depending on how one defines the major and minor axes of the receptacle as discussed in U.S. Pat. No. 4,795,648.

Figure 10:
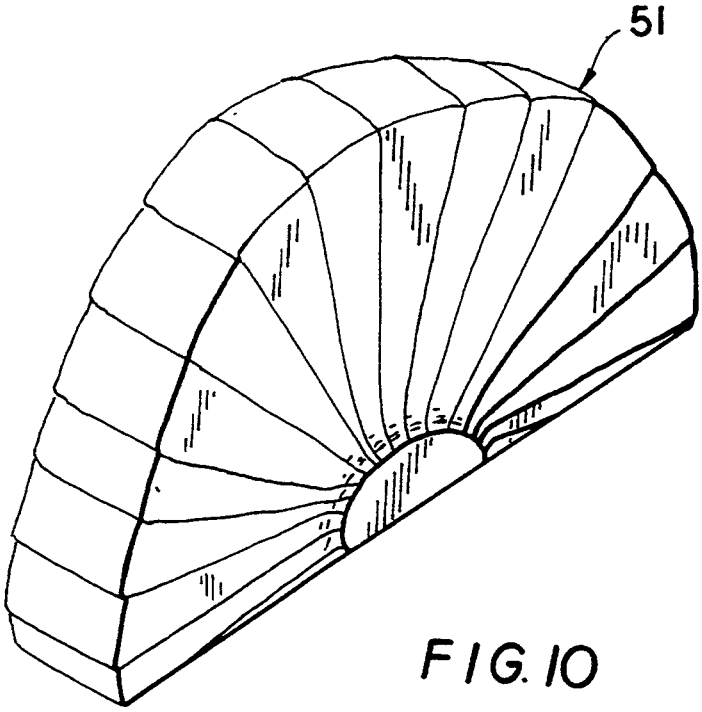
FIG. 10 shows the wrapper of FIG. 9 with the pleated zoned deployed about the cone-shaped container.

The invention described above is particularly suitable for loose products, especially with regard to the embodiments of FIGS. 3 and 10. For these embodiments advantageously the wrapper can be inverted and the pleated section may be used to form a pouch for the loose products. This manner of usage is particularly advantageous when the loose products in the wrapper are consumed in a car. Alternatively the loose products, or the pizza pie may be consumed directly from the receptacle, with the pleated section being deployed under the receptacle formed by the unpleated section and used as a protective napkin.

Obviously, numerous modifications can be made to this invention without departing from its scope as defined in the appended claims.

I claim:

1. A wrapper comprising:

a pleated section formed of a thin and flexible sheet folded along pleat lines to form pleats, wherein said pleated section has two opposed fixed edges perpendicular to said pleat lines which prevent said pleats from unfolding at said fixed edges;

an unpleated section separately formed of a semi-rigid material and having score lines arranged to form said unpleated section into a semi-rigid container for loose products when said unpleated section is folded along said fold lines, said container having two lateral zones, and a central zone disposed in between said lateral zones, said zones being defined by said score lines, said central zone having a central zone edge, said pleated section having one side attached to said central zone edge with said side and edge being generally parallel to said pleat lines, attachment means attaching the one side to said central zone edge, said pleated section when deployed around said container forming a cover closing said container;

wherein said fixed edges are disposed adjacent to said lateral zones as said pleated section is deployed around said container; and wherein each said lateral zone has a curved lateral zone edge, said pleated section when deployed around said container having open pleat portions adjacent to said lateral zone edges.

2. The wrapper of claim 1 wherein said receptable has two diametrically opposed extremities and said pleated section extends angularly past said extremities to form a self-closing wrapper.

3. The wrapper of claim 1 further comprising openings in said container for aeration.

4. The wrapper of claim 3 wherein said openings are covered by said wrapper when deployed around said container.

5. The wrapper of claim 1 wherein said lateral zone edges are in the shape of an arc of circle.

6. The wrapper of claim 5 wherein said arc of circle exceed 180°.

* * * * *